US005440769A

United States Patent [19]

Thomas

[11] Patent Number: 5,440,769

[45] Date of Patent: Aug. 15, 1995

[54] SPECIALTY ITEM FOR USE WHEN HOLDING A BABY

[76] Inventor: Kassandra Thomas, 4045 Sheridan Ave., Miami Beach, Fla. 33140

[21] Appl. No.: 296,442

[22] Filed: Aug. 26, 1994

[51] Int. Cl.[6] ..... A47G 9/00

[52] U.S. Cl. ..... 5/655

[58] Field of Search ..... 5/655, 636, 630, 652, 5/922; D6/601

[56] References Cited

U.S. PATENT DOCUMENTS

| | | | |
|---|---|---|---|
| D. 315,845 | 4/1991 | Lafley | D6/601 |
| 2,250,267 | 7/1941 | Lins | 5/630 |
| 4,393,520 | 7/1983 | Koch | 5/655 |
| 4,627,109 | 12/1986 | Carabelli et al. | 2/44 |
| 5,159,727 | 4/1992 | McCracken | 5/655 |
| 5,239,717 | 8/1993 | Sue | 5/655 |

*Primary Examiner*—Alexander Grosz
*Attorney, Agent, or Firm*—Gary C. Honeycutt

[57] ABSTRACT

A specialty item for supporting a baby's head, while the baby is held by a mother's arm, including a soft foam pad shaped to support a baby's head, combined with a fabric case, shaped for attachment around a mother's arm, to thereby fix the pad in place. The baby's head rest provides greater comfort for both mother and baby, whenever the baby is held for feeding or cuddling. In warm weather the item also avoids the tendency for perspiration to collect on the mother's arm and on the baby's neck and head.

4 Claims, 2 Drawing Sheets

SPECIALTY ITEM FOR USE WHEN HOLDING A BABY

FIELD OF THE INVENTION

This invention relates to specialty items used for making a baby more comfortable while resting on a person's arm; and for helping a person to hold the baby with greater ease and comfort.

BACKGROUND

When holding a baby, the mother frequently places the baby's head at or just above the bend of her arm, opposite the elbow. Over a prolonged period this position can become uncomfortable for both mother and baby, for a variety of reasons, including the collection of moisture between the arm and baby. A towel or similar item is sometimes placed over the mother's arm to relieve discomfort, but it seldom remains in place very long, and is inadequate for other reasons.

U.S. Pat. No. 5,159,727 "Child Care Blanket With Pillow" issued to Jacqueline McCracken on Nov. 3, 1992. It discloses a pillow mounted on a baby blanket, in combination with means for fastening the blanket around the mother's arms so that the pillow is held in a comfortable spot for supporting the baby's head.

A serious disadvantage of the device is the use of an ordinary pillow to support the baby's head. As shown in FIG. 7 of the patent, the pillow does not conform to the rounded shape of the mother's arm. Such a pillow does not provide a stable, comfortable support for the baby's head.

SUMMARY OF THE INVENTION

This invention provides a child care device of the general type disclosed in U.S. Pat. No. 5,159,727, but without the pillow. Instead, the device of this invention comprises a soft foam pad having a novel configuration, in combination with means for holding the pad in place on the mother's arm, and positioned so that the pad supports the baby's head comfortably in all positions, even when the head is turned to either side.

The most common position for the mother is to place the pad in or near the bend of the arm, opposite the elbow. In that position, an ordinary pillow cannot conform to the shape of the mother's arm, to provide optimum comfort for either the mother or the baby. The foam pad of this invention does provide such flexibility and optimum comfort.

In a preferred embodiment, the foam pad includes at least two layers of foam, each layer having a different shape, to provide increased comfort. The pad is covered and sewn between two layers of fabric, so that it becomes integral with the blanket or other fabric fastened around the mother's arm. Fasteners are included to fix the combination in place. For example, Velcro fasteners may be used.

In addition, elastic bands may be provided at opposite ends of the fabric to surround and'grip the arm of the person wearing the item.

DETAILED DESCRIPTION OF THE INVENTION

Figure 1:
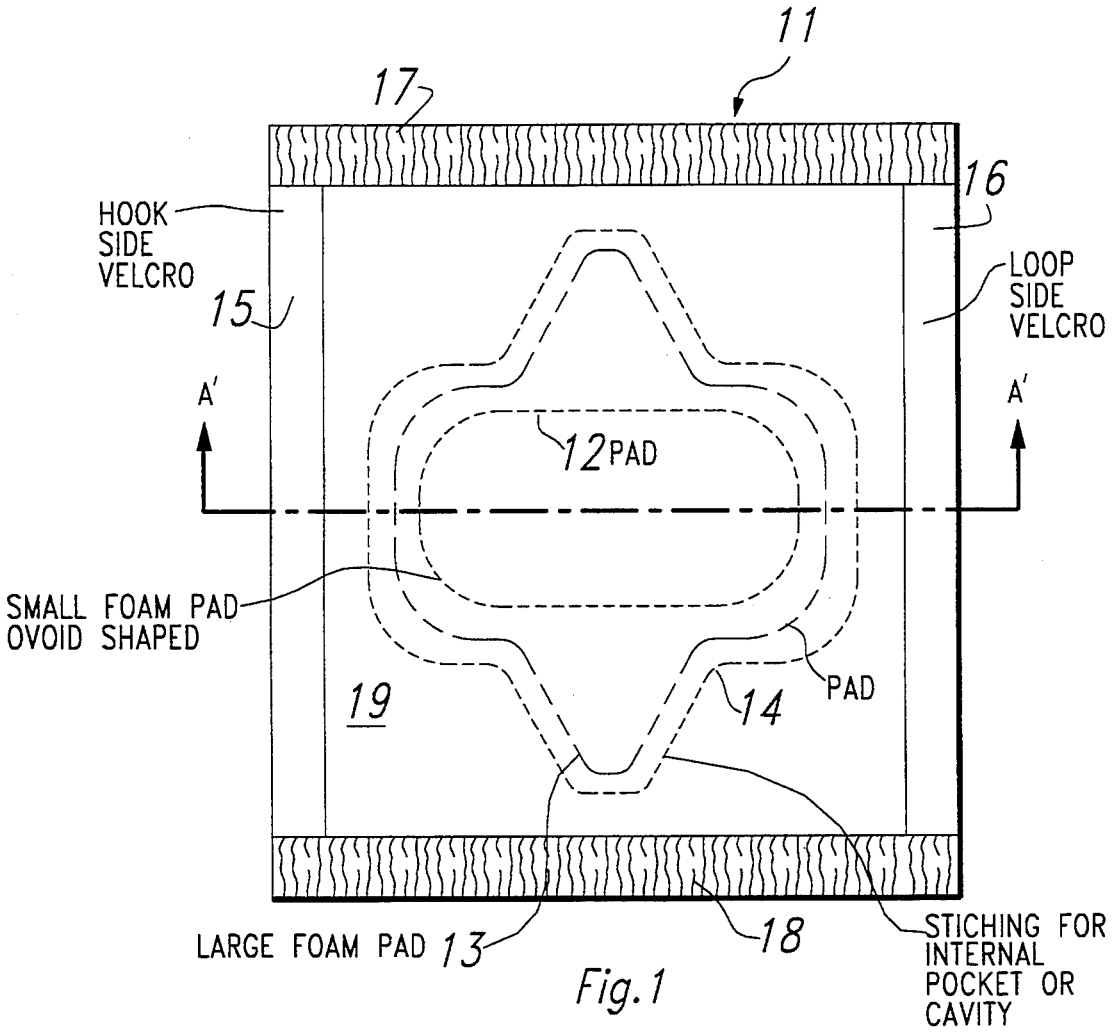
FIG. 1 shows an example of the invention, fully open and lying flat.

In FIG. 1 a baby's head rest 11 is seen to include plastic foam pad 12 having an ovoid shape, for example, and foam pad 13 having a more complex pattern, extending outwardly in two directions from the borders of pad 12. The pads are enclosed between a first layer of fabric 19, and a second layer of fabric 20 (not shown), and held in place by stiches 14. The extended areas of pad 13 provide extra support for the baby's head, neck and back, especially when the baby turns its head. Also, the extended areas provide extra flexibility, enabling the mother to place the pads at the bend of her arm.

Velcro fasteners are provided along opposite sides of the fabric, including hooks 15 and loops 16. In addition, elastic bands 17 and 18 are provided to further hold the assembly in place around the mother's arm. Other fasteners may be substituted for the Velcro, such as a zipper or snap fasteners.

Figure 2:
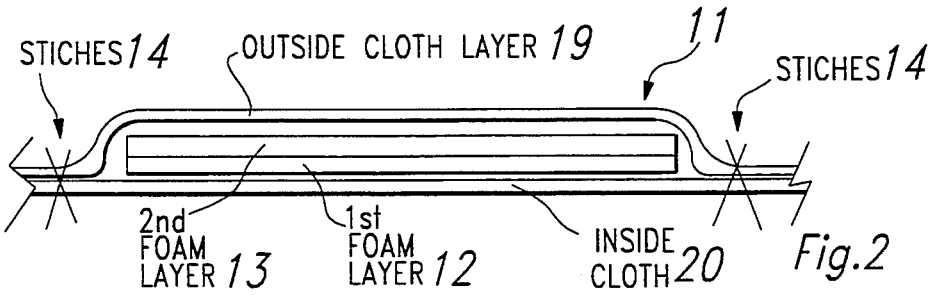
FIG. 2 is a cross-sectional view taken along line A'-A" of FIG. 1.

In FIG. 2 a cross section of the assembly reveals in greater detail how pads 12 and 13 are enclosed between fabric layers 19 and 20, and held in place by stiches 14.

Figure 3:
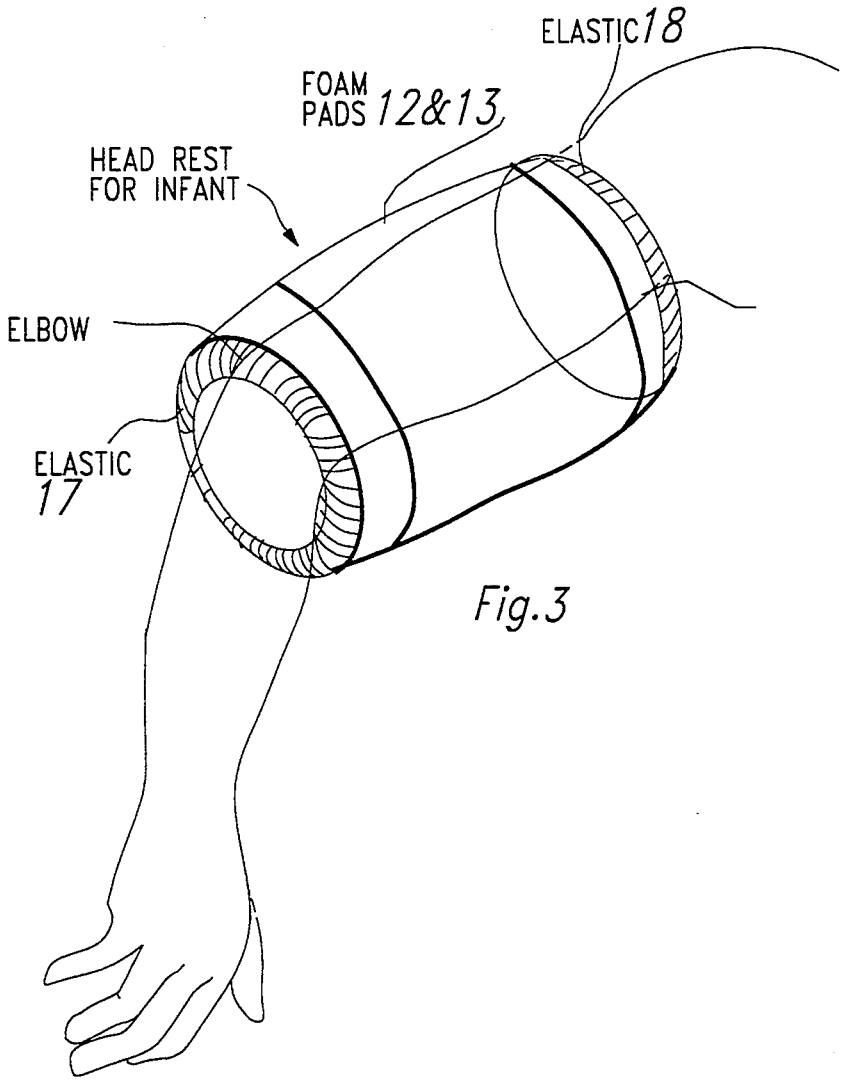
FIG. 3 is a perspective view of the item of FIG. 1, in place on a person's arm.

In FIG. 3 the placement of the head rest around the mother's arm is illustrated, showing the pads located above the elbow, while elastic band 17 may be placed below the elbow, or above, depending upon the preference of the mother, or in some cases upon the length of the mother's arm. The pad may also be placed elsewhere on the mother's arm, for example in the bend of the arm.

Figure 4:
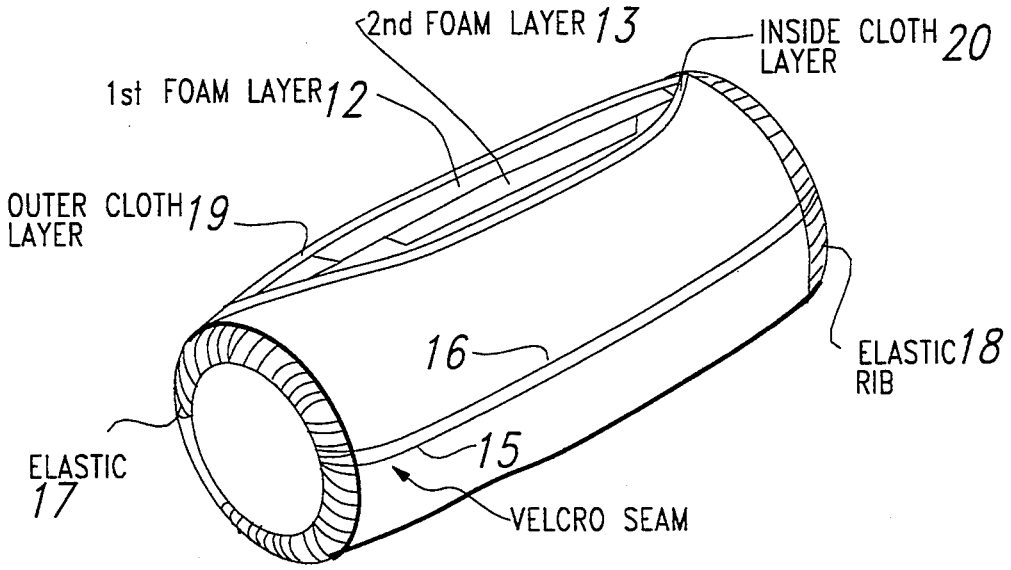
FIG. 4 is a perspective view of the item of FIG. 1 closed by the Velcro fasteners, partially cut away to reveal the pads inside.

In FIG. 4, the closed configuration of the asembly is shown, illustrating-the opening formed to surround the mother's arm. The Velcro seam is closed, and a partially cut away section is shown illustrating placement of the enclosed foam pads 12 and 13. Instead of a Velcro seam, permanent stitching may be provided, so that the device slips onto the mother's arm like a sleeve.

What is claimed is:

1. A specialty item adapted to be removably positioned to surround a substantial portion of a person's arm, for supporting a baby's head, comprising:

a soft pad shaped to support a baby's head without surrounding a person's arm, said pad being comprised of at least tow layers, one of which extends substantially beyond the edges of the other along the length of the wearer's arm;

a fabric enclosure comprising first and second layers stitched to and covering said pad, said enclosure having fabric dimensions that extend well beyond said pad, shaped to surround a person's arm; and means to hold said extended fabric portions in place, around a person's arm, so that the pad remains fixed in a position to support the baby's head.

2. A specialty item as in claim 1, further including elastic bands in the fabric, positioned to surround the person's arm at the upper and lower ends of the item and thereby hold the combination firmly in place.

3. A specialty item as in claim 1 wherein said means for holding the extended fabric portions in place comprises a permanent seam, so that the combination can be pulled on and off like a sleeve.

4. A specialty item as in claim 1, wherein said means for holding the extended fabric portions in place comprises a releasable fastener, so that the combination can be wrapped around a person's arm and fastened, then later released and removed from the arm.

* * * * *